United States Patent [19]

Yolton et al.

[11] 4,219,357

[45] Aug. 26, 1980

[54] METHOD FOR PRODUCING POWDER METALLURGY ARTICLES

[75] Inventors: Charles F. Yolton, Coraopolis; Francis H. Froes, Pittsburgh, both of Pa.

[73] Assignee: Crucible Inc., Pittsburgh, Pa.

[21] Appl. No.: 891,664

[22] Filed: Mar. 30, 1978

[51] Int. Cl.[2] ..... B22F 3/16

[52] U.S. Cl. ..... 75/221; 75/200; 75/211; 75/226

[58] Field of Search ..... 75/200 R, 200.3, 211, 75/221, 226

[56] References Cited

U.S. PATENT DOCUMENTS

| | | | |
|---|---|---|---|
| 2,088,981 | 8/1937 | Sturgis | 75/202 |
| 2,167,240 | 7/1939 | Hensel | 75/200 |
| 2,254,549 | 9/1941 | Small | 75/200 |
| 2,823,116 | 2/1958 | Angier | 75/213 |

FOREIGN PATENT DOCUMENTS

| | | | |
|---|---|---|---|
| 279274 | 12/1926 | United Kingdom | 75/200 |

*Primary Examiner*—Brooks H. Hunt

[57] ABSTRACT

This is a powder metallurgy method for producing fully dense compacted articles from powder charges of hydride-forming alloys, preferably titanium base alloys. The powder is hydrided, sealed in a collapsible container, heated to an elevated temperature and then hot compacted to produce a substantially fully dense article, which is then dehydrided, reheated and again compacted to remove any voids formed during dehydriding. The final article is characterized by relatively fine grain size and excellent formability.

9 Claims, 7 Drawing Figures

METHOD FOR PRODUCING POWDER METALLURGY ARTICLES

It is known to produce powder metallurgy articles by compacting powders of titanium base alloys, as well as alloys of other hydride-forming metals. In practices of this type, the resulting titanium base alloy article is characterized by a vestigial Widmanstatten microstructure with attendant large grain size. This structure may reduce the toughness and workability of the article.

A fine equiaxed grain size will improve the workability of the alloy particularly in operations such as superplastic forming and isothermal forging. Reduced grain size may be expected to increase room and service temperature strength and ductility and fatigue.

It is accordingly the primary object of the present invention to provide a powder metallurgy practice for use with hydride-forming alloys and preferably titanium base alloys, that produces a fully dense compact having a relatively fine grain size and good formability.

This and other objects of the invention as well as a more complete understanding thereof may be obtained from the following description, specific examples and drawings, in which.

Figure 1:
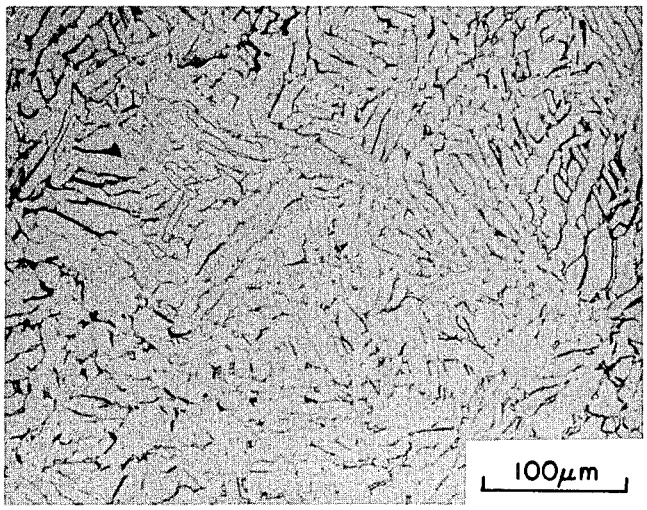
FIG. 1 is a photomicrograph at a magnification of 250X of the microstructure of conventional 6% aluminum, 4% vanadium titanium-base alloy articles.

Broadly, in the practice of the method of the invention a charge of powder alloy of a hydride-forming metal, preferably a titanium-base alloy, is provided. Hydride forming alloys in addition to titanium may be alloys of zirconium, hafnium, tantalum, columbium, uranium and rare earth elements. Since titanium-base alloys are preferred the invention will be described in conjunction therewith. The charge of titanium-base alloy powder, in accordance with the invention, is hydrided to a hydrogen content of at least about 1 to 4% by weight. Any conventional technique may be used for hydriding the titanium alloy powder, but the practice set forth in Cloran U.S. Pat. No. 4,009,233 is preferred. The hydrided powder is introduced to a collapsible container, which is preferably made of mild steel, but any material that is collapsible, sealable and in which hydrogen would have low diffusivity and solubility would be suitable for the purpose. The powder filling container is sealed and heated to an elevated temperature for hot compacting. Temperatures on the order of 1250° to 1800° F. are suitable. Preferably, hot isostatic pressing in a pressure vessel is preferred for hot compacting although practices such as forging and extrusion might be used. In the case of hot isostatic pressing in a fluid pressure vessel pressures within the range of 10,000 to 40,000 psi would be employed.

Compacting is achieved to provide a substantially fully dense article. The article is then dehydrided, which may be achieved in the conventional manner by heating in a vacuum or inert atmosphere, such as argon or helium in which a low partial pressure of hydrogen is maintained. After dehydriding the article is reheated and compacted, which compacting is necessary to remove voids, in the form of cracks, which form during dehydriding. The hot compacting of the dehydrided article is performed at a temperature below the beta transus temperature of the alloy of the acticle. This is necessary if the desired fine grain size is to be achieved. With titanium base alloys grain sizes of less than 10 microns are achieved by the practice of the invention. By way of specific examples demonstrating the utility of the invention titanium-base alloy powders were produced in accordance with the teachings set forth in the aforementioned Cloran patent. The compositions of these powders are set forth in Table I.

TABLE I

| Compositions in Percent by Weight | |
|---|---|
| 6-4 Alloy | Ti-17 Alloy |
| 6% aluminum | 5% aluminum |
| 4% vanadium | 2% tin |
| Bal. titanium | 2% zirconium |
| | 4% molybdenum |
| | 4% chromium |
| | Bal. titanium |

The alloy powders of Table I were used as 100-gram charges and had a hydrogen content of 2.3 to 3.1% by weight. They were placed in a mild steel cylindrical container, sealed, heated to a temperature of 1750° F. for eight hours while in a fluid pressure vessel where compacting was achieved at a pressure level of 15,000 psi. The compact, which was essentially fully dense, was annealed in vacuum at a temperature of 1400° F. to 1475° F. for approximately eight hours for purposes of dehydriding. Metallographic examination of the dehydrided specimens showed cracking, which would necessitate additional hot isostatic pressing.

Figure 2A:
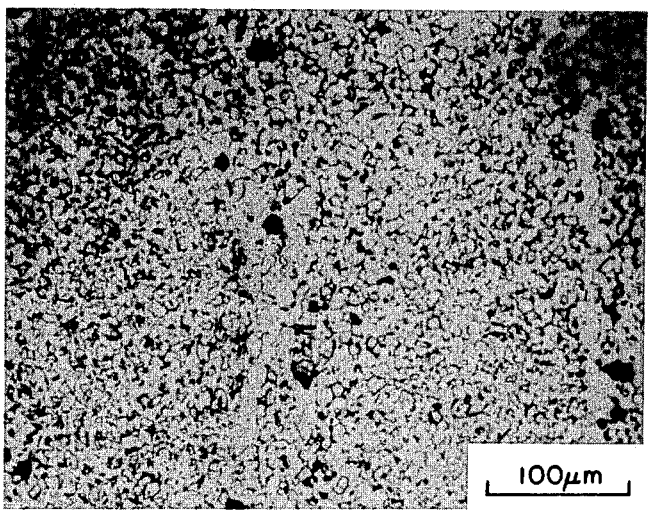
FIGS. 2A and 2B are photomicrographs at a magnification of 500X of the microstructure of an alloy composition identical to that of FIG. 1 but produced in accordance with the invention.
Figure 2B:
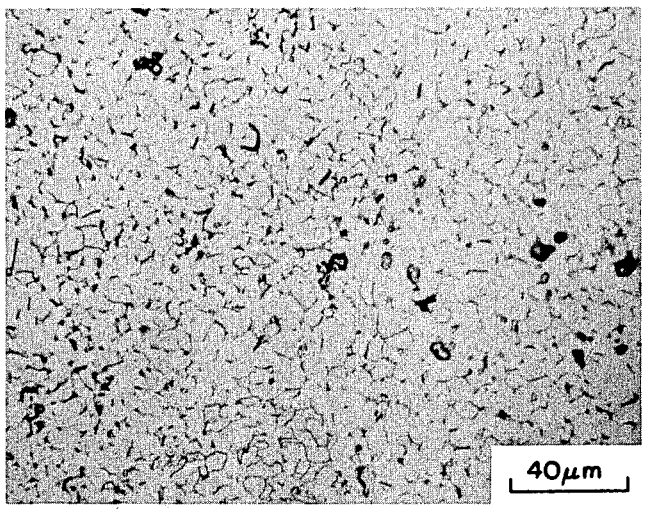

All of the samples exhibited the desired fine microstructure, particularly when compared with the conventional microstructure for the identical 6-4 alloy shown in the photomicrograph of FIG. 1. In contrast, FIGS. 2A and 2B show the 6-4 microstructure after processing in accordance with the invention and specifically hot isostatically pressing at the same temperature as the article with microstructures shown in FIG. 1 was pressed. The drastic difference in the microstructure even at the greater magnification of FIGS. 2A and 2B is evident.

Figure 3:
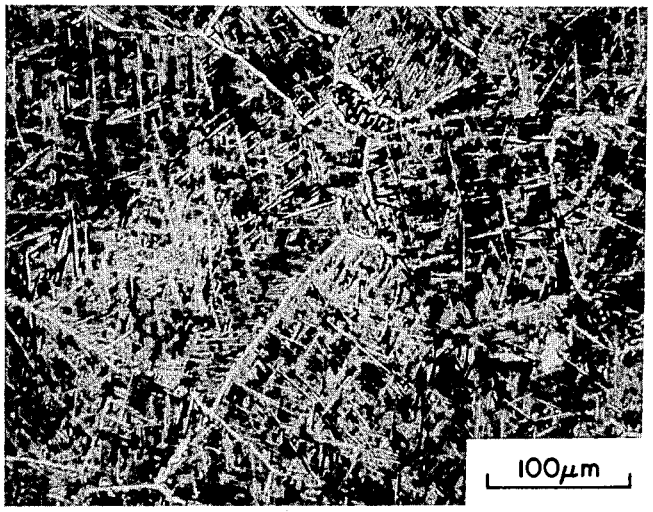
FIG. 3 is a photomicrograph at a magnification of 250X of another titanium-base alloy article produced in the conventional manner and having the composition 5% aluminum, 2% tin, 2% zirconium, 4% molybdenum, 4% chromium and balance titanium.
Figure 5:
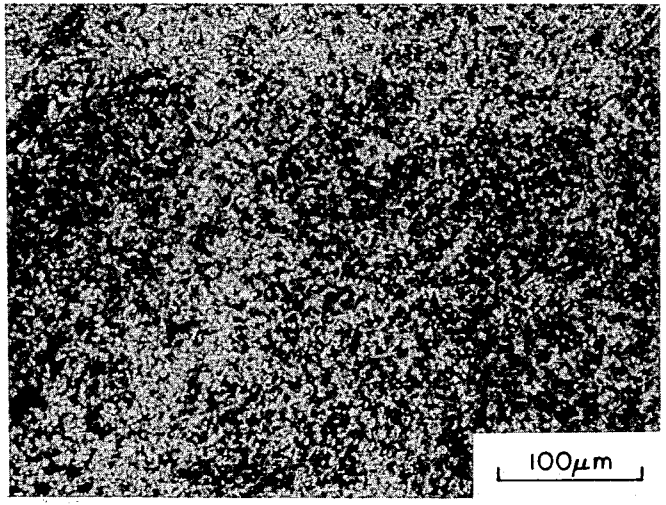
FIG. 5 is a photomicrograph at a magnification of 250X showing the microstructure of the alloy of FIG. 4 after being vacuum annealed at a temperature of 1475° F.
Figure 4:
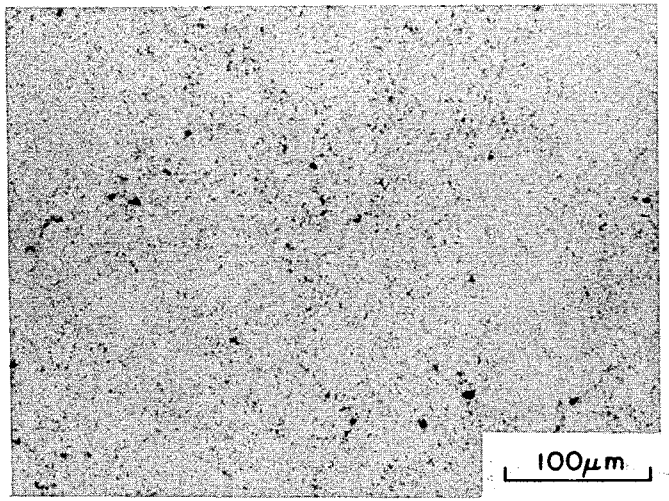
FIG. 4 is a photomicrograph at a magnification of 250X of the identical alloy of FIG. 3 but showing the microstructure resulting from the use of the method of the invention.

A similar series of microstructures for the Ti-17 alloy are illustrated in FIGS. 3, 4, 5 and 6. FIG. 3 shows the microstructure of the Ti-17 alloy produced conventionally, and the large grain size and highly undesirable grain boundary alpha formation is evident. The structure for the alloy after initial hot isostatic pressing in the hydrided state in accordance with the invention is shown in FIG. 4. After dehydriding, a fine grain size results with equiaxed alpha region as shown in FIG. 5.

Figure 6:
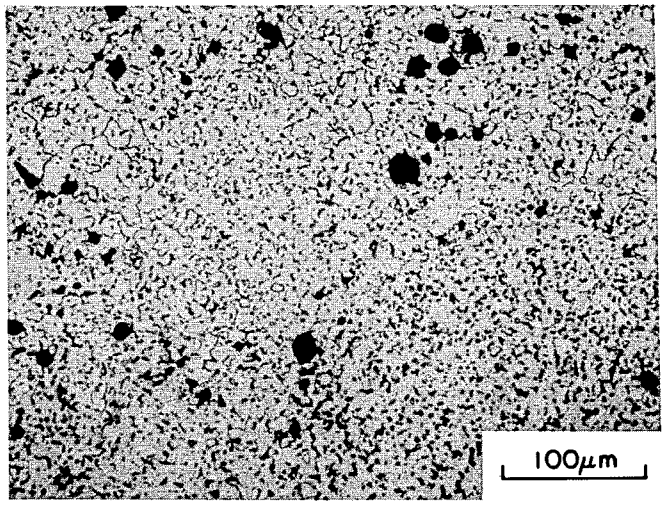
FIG. 6 is a photomicrograph at a magnification of 250X of the alloy of FIG. 5 after an additional annealing at 1650° F. and water quenching.

This is shown clearly in FIG. 6 which shows the article after beta annealing for a short time at 1650° F. and water quenching.

The dehydriding after compaction causes a net volume contraction of the article to produce cracking and void formation in the article. Consequently, it is critical that the article after dehydriding be subjected to further compacting, such as by hot isostatic pressing, forging or extrusion, to close these cracks and voids and thus provide the desired integral article.

The fine grain size produced in accordance with the method of the invention is believed to be explainable as follows. The relatively large grain powder is characterized by a network of intersecting hydride phase. On hot isostatic pressing the interstices between the powder particles are eliminated by the working with a concurrent distortion of the hydride network within the grains. When the article is then dehydrided, separate grains are formed between the former hydride phase regions. This results because of the distortion of these regions during the hot isostatic pressing cycle wherein the matrix lattice is distorted so that upon dehydriding, the lattice planes of adjacent regions, which formerly matched exactly, no longer match and high angle boundaries, e.g. grain boundaries, separate these regions. Since it is the distorting influence of the hot isostatic pressing cycle on the hydride phase that appears to be essential to achieve the result of the invention it is believed that any working which produces this effect, such as extrusion would also be suitable for the purpose.

Although reference is made in the specification and in the claims to "metal" it is understood that this is intended to mean alloys of these metals wherein the metal constitutes the alloy base.

We claim:

1. A method for producing compacted articles from powder of a hydride-forming alloy comprising introducing hydrided powder of a hydride-forming alloy to a collapsible container, sealing said container and heating the powder to an elevated temperature suitable for compacting, hot compacting said powder to produce a substantially fully dense article, dehydriding said article, reheating said dehydrided article and compacting said dehydrided article to remove voids formed during said dehydriding.

2. The method of claim 1 wherein said hydride-forming alloy is an alloy selected from the group consisting of titanium, zirconium, hafnium, tantalum, columbium, uranium and rare-earth elements.

3. A method for producing compacted articles from titanium alloy powder comprising introducing hydrided titanium alloy powder to a collapsible container, sealing said container and heating the powder to an elevated temperature suitable for compacting, hot compacting said powder to produce a substantially fully dense article, dehydriding said article, reheating said dehydrided article and hot compacting said dehydrided article to remove voids formed during said dehydriding.

4. The method of claim 3 wherein said hot compacting of said powder is achieved by hot isostatic pressing in a fluid pressure vessel.

5. The method of claim 4 wherein said powder is at a temperature within the range of 1250° to 1800° F. during said hot isostatic pressing.

6. The method of claim 5 wherein said hot isostatic pressing is conducted at a pressure within the range of 10,000 to 40,000 psi.

7. The method of claim 3 wherein said hydrided titanium alloy powder has a hydrogen content of about 1 to 4% by weight.

8. The method of claim 3 wherein said hot compacting of said dehydrided article is performed at a temperature below the beta transus temperature of the article.

9. A method for producing compacted articles from titanium alloy powder comprising introducing hydrided titanium alloy powder to a collapsible container, said hydrided powder having a hydrogen content of about 1 to 4% by weight, sealing said container and heating said powder to a temperature within the range of 1250° to 1800° F., hot isostatic pressing said powder in a fluid pressure vessel at a pressure within the range of 10,000 to 40,000 psi to produce a substantially fully dense article, dehydriding said article, reheating said dehydrided article and hot compacting said dehydrided article at a temperature below the beta transus temperature to remove voids produced during said dehydriding.

* * * * *